United States Patent [19]

Love

[11] 3,993,253

[45] Nov. 23, 1976

[54] DISINTEGRATED DEVICES

[76] Inventor: Gordon David Love, Waterside, Chesham, Buckinghamshire, England

[22] Filed: Feb. 20, 1975

[21] Appl. No.: 551,263

Related U.S. Application Data

[63] Continuation-in-part of Ser. No. 315,309, Dec. 15, 1972, Pat. No. 3,897,013.

[30] Foreign Application Priority Data

Dec. 17, 1971 United Kingdom ..... 58880/71

[52] U.S. Cl. ..... 241/46.11; 241/46.17

[51] Int. Cl.[2] ..... B02C 18/08

[58] Field of Search ..... 241/43, 46.11, 46.17, 241/101 B, 152 R, 155, 162

[56] References Cited

UNITED STATES PATENTS

| | | | |
|---|---|---|---|
| 2,873,026 | 2/1959 | Nieuwenhuis | 241/46.17 X |
| 3,163,368 | 12/1964 | Johnson | 241/46.17 |
| 3,897,013 | 7/1975 | Love | 241/46.11 |

*Primary Examiner*—Granville Y. Custer, Jr.
*Attorney, Agent, or Firm*—Browdy and Neimark

[57] ABSTRACT

Apparatus including a disintegrating head and a mixing head each having a stator and a co-operating rotor. The rotors are mounted at axially spaced locations on a common shaft and the stators are supported with the inlet to each stator facing axially of the shaft, away from the other stator. The disintegrating head has a stator formed of a plurality of stator elements arranged at angulary spaced locations on a base member. Each stator element has a cutting edge which is inclined outwardly of the element in a direction away from the base member. Associated with the disintegrating head is a shroud which serves to retain large lumps of material in the vicinity of the head.

12 Claims, 10 Drawing Figures

DISINTEGRATED DEVICES

This application is a continuation-in part of Ser. No. 315,309 filed Dec. 15, 1972 now U.S. Pat. No. 3,897,013 of July 29, 1975.

This invention relates to disintegrating devices.

The present invention includes a disintegrating device comprising a rotor and a co-operating stator, wherein the rotor comprises a plurality of blades mounted on an elongated shaft and the stator comprises a plurality of stator elements extending from a base member at locations angularly spaced about the axis of the rotor shaft, each stator element having a cutting edge formed by the intersection of a radially inner face of the element and an adjacent side face at least part of which extends away from the base member in a direction outwardly of the element.

The invention also includes a disintegrating device comprising a rotor mounted on an elongated shaft, a co-operating stator having an inlet at one end and outlet means at the side thereof, and retaining means which are disposed coaxially of the shaft radially outwardly thereof and extending axially outwardly thereof beyond the inlet, whereby, in use, material drawn towards the stator inlet by rotation of the rotor and subjected to disintegration by the action of the rotor and stator is retained in the vicinity of the rotor and stator by the retaining means.

The invention also includes a mixing device comprising a pair of mixing heads each of which comprises a rotor, and a stator having an inlet at one end and outlet means at the side thereof, wherein the rotors are mounted at axially spaced locations on a common shaft and each stator is arranged with the inlet thereof facing in an axial direction away from the other stator.

The invention will now be described, by way, of example, with reference to the accompanying drawings, in which.

Figure 1:
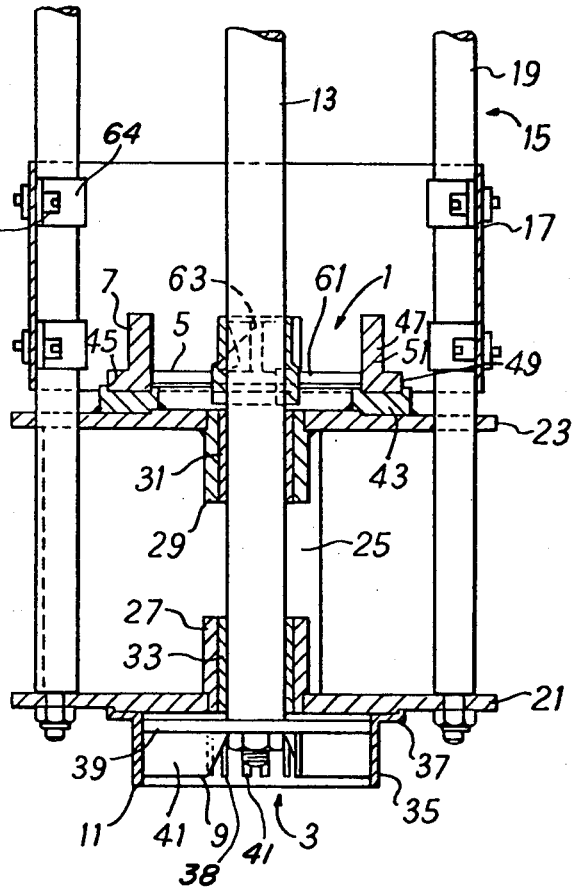
FIG. 1 is a longitudinal section of a first apparatus according to the invention.
Figure 2:
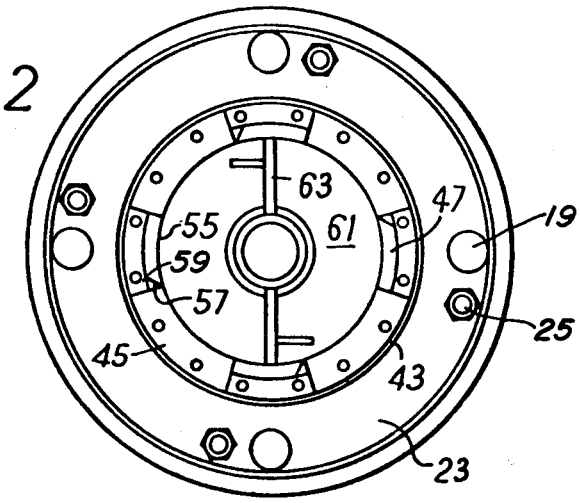
FIG. 2 is a plan view of the apparatus of FIG. 1.
Figure 3:
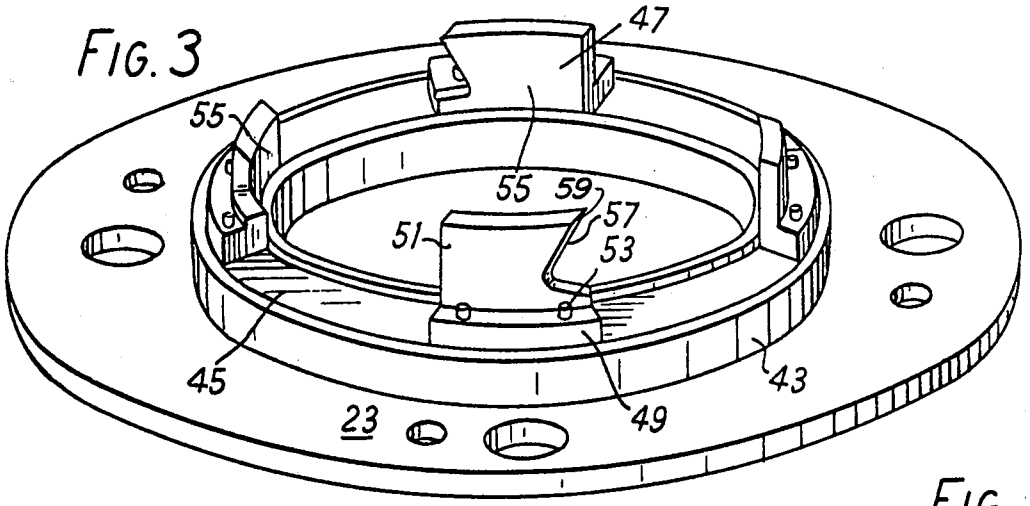
FIG. 3 is a perspective view of the stator in the disintegrating head of the apparatus of FIG. 1.

The apparatus shown in FIGS. 1 to 3 is suitable for disintegrating lumps of strong, tough polymers and similar natural and synthetic materials and subsequently mixing the material with oil, water or other solvents or liquid vehicles.

Referring to FIG. 1, the present apparatus includes a disintegrating head 1 which is particularly suitable for breaking down lumps of a polymer into small pieces and a mixing head 3 for mixing the small pieces with a solvent, such as oil. The head 1 includes a rotor 5 and a stator 7 and the head 3 includes a rotor 9 and a stator 11, the two rotors being mounted on a common shaft 13 and the two stators being mounted on a common support 15. Associated with the disintegrating head 1 is a cylindrical shroud 17. In use, the support 15 is secured to the casing of an electric motor (not shown) and the common shaft 13 is coupled to an output shaft of the motor.

In the present apparatus the common support 15 for the disintegrating and mixing heads 1 and 3, respectively, includes four pillars 19 which depend from a mounting plate (not shown) secured to the motor casing. A lower supporting plate 21 for the stator 11 of the mixing head 3 is secured to the lower ends of the pillars 19. An upper supporting plate 23 for the stator 7 of the disintegrating head 1 is supported a short distance above the plate 21 by means of four further pillars 25, the plate 23 being formed with four apertures through which respective pillars 19 extend. Each of the supporting plates 21 and 23 is formed with a central aperture and fitted into these apertures, and secured to the plates by welding are short tubes 27 and 29, respectively. The common rotor shaft 13 extends downwardly from the motor and is journalled in bearing sleeves 31 and 33 fitted into respective tubes 27 and 29 on the supporting plates 21 and 23.

The stator 11 of the mixing head 3 consists of an apertured, cylindrical side wall 35 which is formed with an outer flange 37 at an upper end thereof. The flange 37 is bolted to the under-surface of the lower supporting plate 21, coaxially of the rotor shaft 13. Each aperture in the side wall 35 is an elongated slot 38 which extends parallel with the axis of the rotor shaft 13.

The rotor 9 of the mixing head 3 is formed of a rotor plate 39 and four blades 41 which depend from the under-surface of the plate 39. The rotor 9 is secured to a section of the rotor shaft 13 which is within the stator 11 and each rotor blade 41 extends radially outwardly from the shaft 13 to a radial location adjacent to an inner surface of the side wall 35 of the stator.

Referring to FIGS. 1 to 3, the stator 7 of the disintegrating head 1 includes a base ring 43 which is welded to the upper surface of the upper supporting plate 23, coaxially of the rotor shaft 13. An annular groove 45 is formed in the upper surface of the ring 43 and four stator elements 47 are fitted into the groove 45 at locations equi-angularly spaced about the axis of the rotor shaft 13.

Each stator element 47 of the disintegrating head 1 is formed of a base 49 and a cutter 51 which is upstanding from the base. The base 49 of each stator element 47 is shaped to form a segment of a ring, as viewed in plan, and is fitted into the annular groove 45 in the base ring 43. Each element 47 is secured to the ring 43 by bolts 53 which extend through apertures in its base 49. The cutter 51 of each stator element 47 has a radially inner face 55 which is part cylindrical and is disposed coaxially with the rotor shaft 13 and an adjacent side face 57 which intersects the radially inner face at an acute angle, thereby to form a cutting edge 59 for the element. The side face 57 is formed of upper and lower sections. The lower section, which is adjacent to the base 49 of the element, is inclined upwardly in a direction inwardly of the element at an angle of approximately 20° to the upper surface of the ring 43. There is therefore an initial decrease in width of each element 47 in moving upwardly from the base 49. The upper section of each side face 57 intersects the radially inner face 55 of the element at an angle of 34°. This upper section is inclined upwardly and outwardly of the element at an angle of approximately 30° to the ring 43 so that the upper part of the element increases in width in an upwards direction.

The rotor 5 of the disintegrating head 1 is formed of a circular plate 61 which is secured to the rotor shaft 13 at a vertical location corresponding to the vertical location of the base 49 of each stator element 47. Upstanding from the plate 61 are two rotor blades 63 which extend outwardly from the rotor shaft 13 at diametrically opposed locations, a peripheral edge of each blade 63 describing a cylindrical surface adjacent to the radially inner surfaces 55 of the stator elements 47 when the rotor is rotated.

Associated with the disintegrating head 1 of the present apparatus is the cylindrical shroud 17 which extends coaxially of the rotor shaft 13. The shroud 17 is secured to the pillars 19 of the support 15 by U-shaped clips 64, each clip embracing one of the pillars 19 and being secured to the shroud 17 by means of screws 66. The shroud 17 is disposed exteriorly of the stator 7 of the disintegrating head 1 with its lower end spaced above the supporting plate 23 for the head at a vertical location approximately the same as the vertical location of upper surface of the base ring 43 for the stator.

Figure 1A:
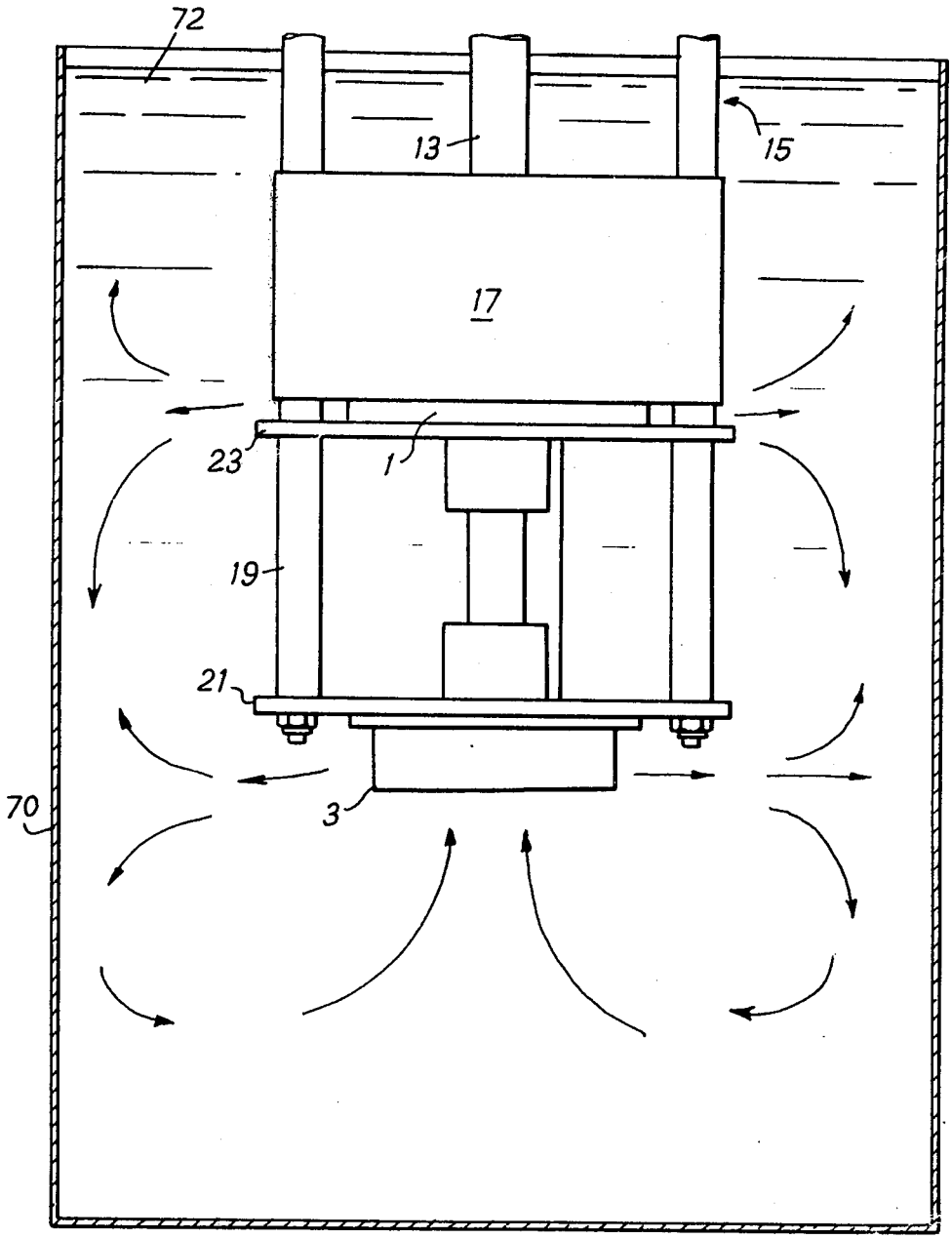
FIG. 1A is a side view of the apparatus of FIG. 1 supported within a mixing vessel.

In the present apparatus the disintegrating head 1 has a rotor plate 61 which is 12 inches in diameter and rotor blades 63 which are 2½ inches in height. Each stator element 47 of the head 1 has an overall height of 4¼ inches and the shroud 17 is 2 feet high. In use, the motor is arranged above a mixing vessel 70 filled with oil 72 and is then moved downwardly until both heads 1 and 3 and the shroud 17 are immersed in the oil as shown in FIG. 1A. Lumps of a polymer having a major dimension of 12 inches or more are also introduced into the vessel 70.

Upon energising the motor the blades 63 of the rotor 5 in the disintegrating head 1 are rotated and oil in the vicinity of the blades is forced radially outwardly through the spaces between the stator elements 47 and then through the space between the shroud 17 and the upper supporting plate 23. A strong vortex action is set up and further oil and lumps of polymer are drawn downwardly into the shroud 17 and into the vicinity of the head to replace the oil expelled.

Once a lump of polymer is adjacent to the rotor blades 63 it is forced round by the blades and impinges against one of the stator elements 47. The sense of rotation of the blades 63 is such that the lump is forced against the upper end of the cutting edge 59 of an element 47. Impact with the cutting edge causes a small piece of polymer to be removed from the lump and expelled outwardly from the stator elements 47 towards the shroud 17. The remainder of the lump may bounce upwardly away from the stator elements 47 after impact but it is immediately forced downwardly again by the vortex action and impinges against another element 47. Outwards movement is restricted by the shroud 17 and downward movement, away from the elements 47, is prevented by the radially outer part of the plate 23. In the result, the shroud 17 and the outer part of the plate 23 retain the lump in the vicinity of the elements 47 and the lump tends to bounce around the upper end of the stator elements, impinging against succeeding elements 47 in rapid succession. Impact with an element 47 removes a small piece of material from the lump and there is a rapid reduction in size.

As the size of the lump decreases it is able to move further into the gap between adjacent stator elements 47. Such movement is assisted by the inclination of the upper part of the face 57 of each element 47, thereby increasing the time over which impact of the lump with the element extends and improving the prospect of each impact shredding a small piece of material from the lump.

Small pieces of polymer which are cut away from the lumps by the disintegrating head 1 are able to move between the shroud 17 and the upper supporting plate 23, away from the vicinity of the head. These pieces move into the main body of oil in the mixing vessel. Here they are ultimately subjected to the vortex action set up by the rotating blades 41 of the rotor 9 in the mixing head 3. Oil and pieces of polymer subjected to this action are drawn upwardly into the mixing head 3 and then expelled radially outwardly through the apertured side wall 35 of the stator 11. In passing between a rotor blade 41 and the side wall 35, and in moving through the apertures in the wall 35, the pieces are subjected to shearing forces which reduce the size of the pieces and ultimately bring about thorough mixing with the oil.

Figure 4:
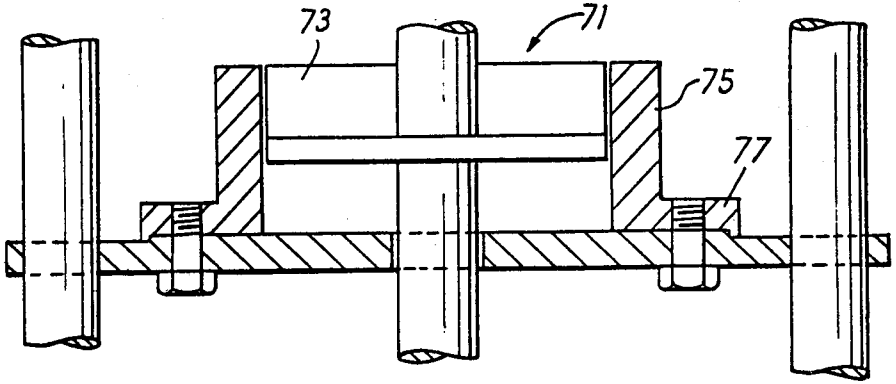
FIG. 4 is a longitudinal section of a disintegrating head in a second apparatus according to the invention.
Figure 5:
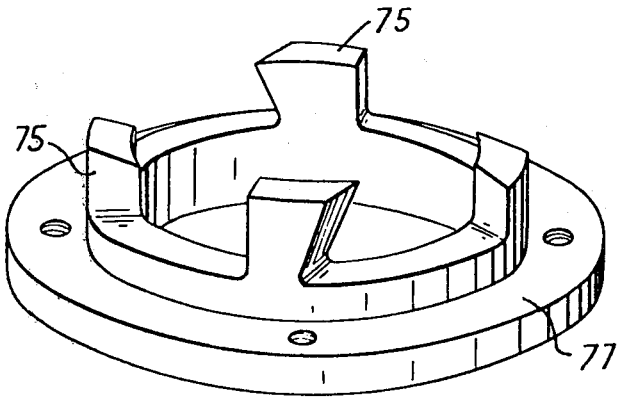
FIG. 5 is a perspective view of the stator in the head of FIG. 4.

Referring to FIGS. 4 and 5, a second apparatus according to the invention has a disintegrating head 71 wherein a rotor 73 is constructed in similar fashion to the rotor 5 of the apparatus shown in FIGS. 1 to 3. In this second apparatus, however, stator elements 75 are formed integrally with a base ring of the stator rather than being releasably secured thereto by bolts. The base ring 77 itself is bolted to the upper supporting plate.

Figure 6:
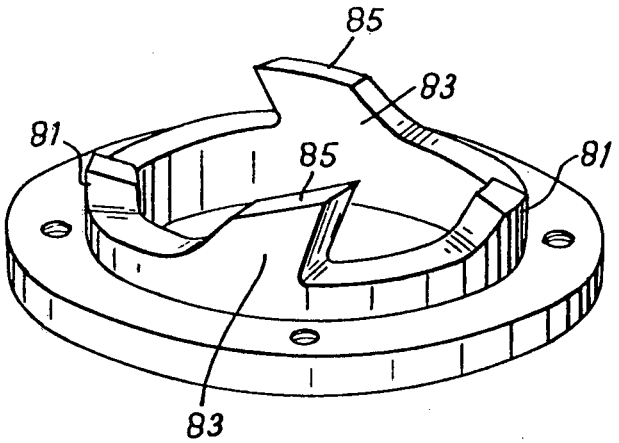
FIG. 6 is a perspective view of a stator in a third device according to the invention.

Referring to FIG. 6 a further apparatus according to the invention has a stator in which one pair of diametrically opposed stator elements 81 are reduced in height relative to the height of the other pair of elements 83. Each of the elements 81 and 83 has an upper face 85 which slopes downwardly away from the two faces which intersect to form the cutting edge of the element. This provides a sharper point at the upper end of the elements and assists in shredding pieces from large lumps of material.

It will be appreciated that the large angular spacing between adjacent stator elements in the heads 1 and 71 described above faciliates movement of relatively large lumps into engagement with the cutting edges. In practice, it is found that an angular spacing between each cutting edge and the adjacent stator element which is less than the "height" of the cutting edge (the distance over which the cutting edge extends in an axial direction) can provide useful results in a device of this size. For devices wherein the rotor and stator are smaller in diameter it is found desirable to maintain the angular spacing at least equal to the height of the cutting edge so as to allow lumps of reasonable size to enter into engagement with the cutting edge.

It will be further appreciated that the disintegrating head 1 can be used without the mixing head 3 if it is not necessary to reduce the size of the lumps below the size of the lumps which are able to escape from the interior of the shroud 17. Further, the shroud 17 can also be removed if conditions are such that there is no problem in keeping the lumps in the vicinity of the head 1. This may be because the lumps do not float away from the head or because the sides of the mixing vessel are themselves shaped to retain the lumps near to the head.

If the lumps are not large the head 1 can be replaced by a head which is similar in construction to the head 3. The outlet apertures in the replacement head can be of the same size or different in size to the apertures in head 3. Using two heads produces a desirable flow pattern in the volume of liquid, material which is difficult to wet being drawn downwardly by the vortex action of the upper head and material in the lower part of the vessel being drawn up by the vortex action of the lower head. The flow pattern also enables mixing to be effected in higher viscosity liquids than is possible with a single head of comparable size. To enable the apparatus to be used in different depths of liquid provision is made for adjusting the axial spacing between the two heads. In the apparatus of FIGS. 1 to 3 this is done by using rods 25 of different length.

Figure 7A:
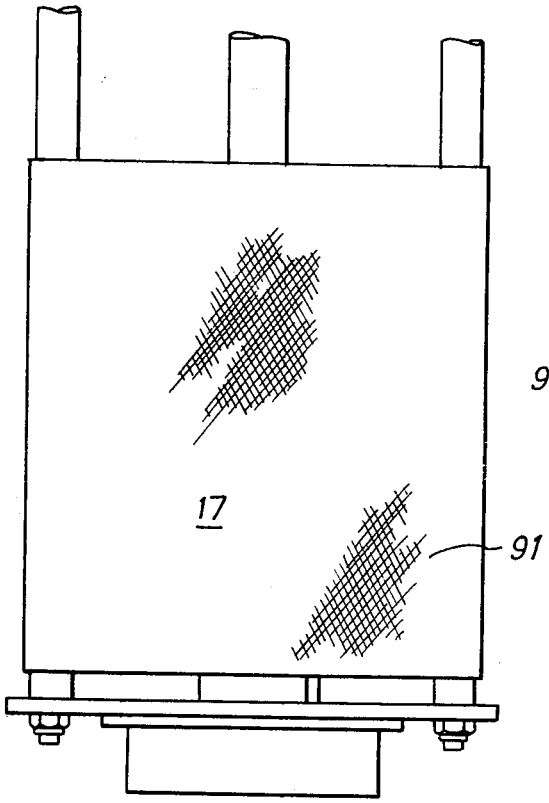
FIGS. 7A and 7B are side elevations of respective fourth and fifth apparatus according to the invention and FIG. 7C is a plan view of a sixth apparatus according to the invention.
Figure 7B:
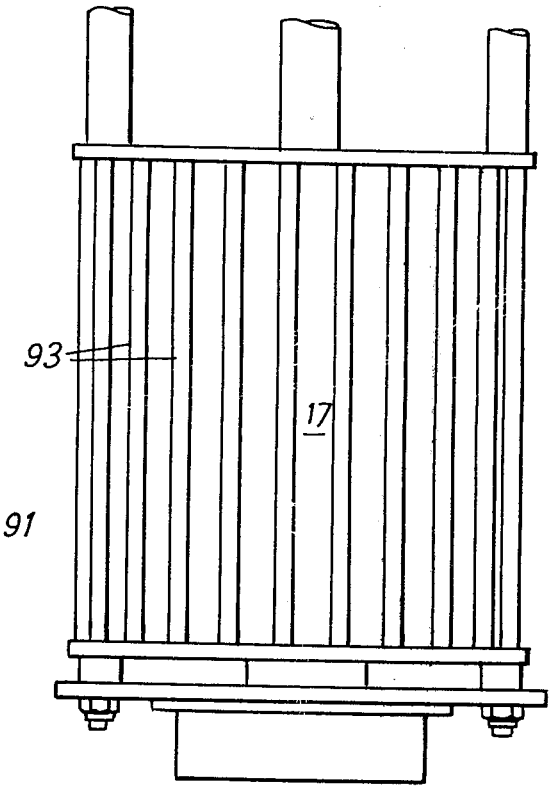

The shroud 17 can be used with a device having only one head and this head can be one having conventional rotor and stator elements. To enable variation in the size of pieces which are able to escape from the vicinity of the head the spacing between the shroud and the plate 23 can be varied by loosening the screws 66, adjusting the axial location of the shroud on the rods 19 and then tightening the screws 66. The shroud 17 can also be replaced by an element formed with apertures whose size determine the size of particles which are able to escape therefrom. Thus, the shroud may be constructed of a mesh or an apertured cylinder 91, as shown in FIG. 7A or of a series of mutually spaced, parallel arranged bars 93, as shown in FIG. 7B.

Figure 7C:
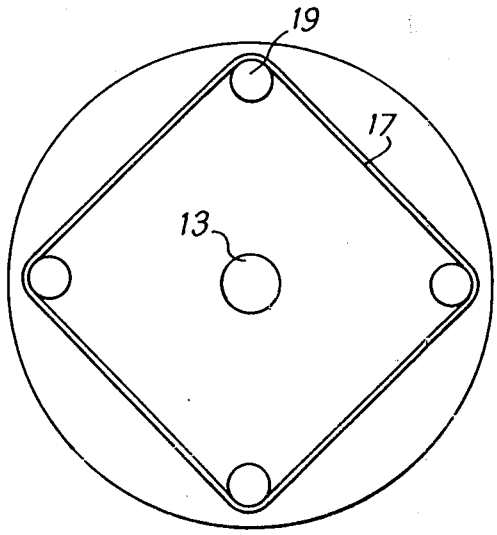

Finally, the shroud 17 may be formed of three or more upright planar side walls so that the shroud has a triangular, rectangular or other polygonal shape, as viewed in plan. A plan view of a rectangular shroud is shown in FIG. 7C. This reduces the rate at which the volume of liquid within the shroud is rotated when the rotor in the associated mixing or disintegrating head is energized. The blades of the rotor are then more effective to draw material within the shroud downwardly to the head and an improved rate of mixing or disintegration is obtained.

What is claimed is:

1. A disintegrating device comprising a rotor which comprises an elongated shaft, a rotor plate mounted on the shaft, and a plurality of blades projecting from one side of the rotor plate, a stator which is disposed coaxially of the rotor shaft, the rotor being arranged with the rotor blades within the stator, and the stator comprising means for cooperating with the blades on the rotor, when the rotor is rotated, in effecting a reduction in size of lumps of solid, and retaining means formed with aperture means of a predetermined size, means for supporting the stator and the retaining means so that the retaining means are disposed radially outwardly of the stator and extend axially beyond an axially outer end of the stator; whereby the rotor upon rotation may draw a mixture of liquid and solid in which the device can be immersed in an axial direction towards the axially outer end of the stator, the blades on the rotor and the cooperating means on the stator then effecting a reduction in size of lumps of the solid, the rotating rotor then forcing the liquid and the lumps of solid outwardly towards the retaining means, and the retaining means retaining large lumps of solid in the vicinity of the rotor and the stator while smaller lumps are able to move away via the aperture means.

2. A disintegrating device as claimed in claim 1 wherein the retaining means are formed with a series of apertures which allow small lumps of solid to move away from the vicinity of the rotor and stator.

3. A disintegrating device as claimed in claim 1 wherein the retaining means comprise a hollow, generally cylindrical shroud member.

4. A disintegrating device as claimed in claim 1, wherein at least part of the retaining means is formed as a mesh.

5. A disintegrating device as claimed in claim 1, wherein the stator comprises a generally cylindrical side wall formed with outlet apertures, whereby the rotor upon rotation may draw the mixture into the stator and then to expel the material radially outwardly via the outlet apertures, the lumps being reduced in size in passing between the rotor and the stator.

6. A disintegrating device as claimed in claim 1, wherein the stator comprises a plurality of angularly spaced stator elements, whereby the rotor upon rotation, may draw the mixture in an axial direction so that larger lumps are subjected to a reduction in size by impact with the stator elements, smaller lumps being subjected to a reduction in size in passing between the rotor and the stator elements as they are expelled outwardly toward the retaining means.

7. A disintegrating device as claimed in claim 1, wherein at least a part of the retaining means is formed of parallel, spaced bars.

8. A disintegrating device as claimed in claim 1, wherein the retaining means comprise two spaced parts, and the aperture means in the retaining means are formed by the space between said two spaced parts of the retaining means.

9. A disintegrating device as claimed in claim 8, wherein one part of the retaining means is fixedly secured to the supporting means, the other part of the retaining means is movably mounted on the supporting means, and means are provided for adjusting the position of the said other part on the supporting means, thereby to adjust the position of the said other part relative to the said one part and to vary the size of the aperture means.

10. A disintegrating device as claims in claim 8, wherein one part of the retaining means is a supporting plate secured to the supporting means, the stator is supported, at the end thereof remote from the said axially outer end of the stator, on the supporting plate, the supporting plate extending radially outwardly of the stator, and the other part of the retaining means is spaced from the supporting plate.

11. A disintegrating device as claimed in claim 10 wherein the supporting plate extends radially outwardly beyond the other part of the retaining means, and the said other part is spaced from the supporting plate in an axial direction.

12. A disintegrating device as claimed in claim 11, wherein means are provided for adjusting the axial location of the said other part relative to the supporting plate.

* * * * *